US007343764B2

(12) United States Patent
Solfronk

(10) Patent No.: US 7,343,764 B2
(45) Date of Patent: Mar. 18, 2008

(54) PLACING TOOL WITH MEANS FOR CONTROLLING PLACING PROCESSES

(75) Inventor: Antonin Solfronk, Albrechitce nad Vlatavou (CZ)

(73) Assignee: MS Geraetebau GmbH, Osnabreuck (DE)

( * ) Notice: Subject to any disclaimer, the term of this patent is extended or adjusted under 35 U.S.C. 154(b) by 335 days.

(21) Appl. No.: 10/502,214

(22) PCT Filed: Jul. 24, 2003

(86) PCT No.: PCT/EP03/00380

§ 371 (c)(1),
(2), (4) Date: Apr. 4, 2005

(87) PCT Pub. No.: WO03/059551

PCT Pub. Date: Jul. 24, 2003

(65) Prior Publication Data

US 2005/0217097 A1 Oct. 6, 2005

(30) Foreign Application Priority Data

Jan. 21, 2002 (DE) ..... 102 02 230
Sep. 28, 2002 (WO) ..... PCT/EP02/10914
Oct. 16, 2002 (DE) ..... 102 48 298

(51) Int. Cl.
*B21J 15/28* (2006.01)
*B23Q 17/00* (2006.01)
*B23P 11/00* (2006.01)

(52) U.S. Cl. ..... 72/20.1; 72/391.4; 29/407.05; 29/243.523; 29/243.525; 227/3; 700/175; 73/756; 73/774

(58) Field of Classification Search ..... 29/407.1, 29/407.8, 407.5, 525.06, 243.519, 243.521, 29/243.523, 243.524; 72/20.1, 21.1, 21.4, 72/391, 4, 391.6; 227/1, 2, 3, 4; 700/108–110, 700/175, 180; 73/756, 774
See application file for complete search history.

(56) References Cited

U.S. PATENT DOCUMENTS

| | | | | |
|---|---|---|---|---|
| 4,901,431 | A | 2/1990 | Gast | 29/707 |
| 5,600,878 | A * | 2/1997 | Byrne et al. | 29/243.525 |
| 5,661,887 | A * | 9/1997 | Byrne et al. | 29/243.525 |
| 5,666,710 | A | 9/1997 | Weber et al. | 29/243.523 |
| 6,161,629 | A | 12/2000 | Hobmann et al. | 173/181 |
| 6,276,050 | B1 | 8/2001 | Mauer et al. | 29/716 |
| 6,502,008 | B2 * | 12/2002 | Maurer et al. | 700/175 |
| 7,024,746 | B2 * | 4/2006 | Weeks et al. | 29/407.08 |
| 7,123,982 | B2 * | 10/2006 | Mauer et al. | 700/175 |

(Continued)

FOREIGN PATENT DOCUMENTS

DE 4401134 A1 7/1995

(Continued)

*Primary Examiner*—David B Jones

(74) *Attorney, Agent, or Firm*—Ohlandt, Greeley, Ruggiero & Perle, L.L.P.

(57) ABSTRACT

A rivet setting tool is provided to provide improved monitoring of riveted connections during rivet setting. The rivet setting tool includes a head piece for holding a rivet, a device for gripping a rivet pin, a pulling apparatus connected to the device for gripping a rivet pin, and a device for measuring the tension of the pulling apparatus. Using the setting implement according to the invention, a cause of a fault can be determined by means of a comparison between measured values and stored values.

52 Claims, 7 Drawing Sheets

U.S. PATENT DOCUMENTS

| | | | | |
|---|---|---|---|---|
| 2001/0039718 | A1 | 11/2001 | Mauer et al. | 29/701 |
| 2006/0230591 | A1* | 10/2006 | Chitty et al. | 29/243.523 |

FOREIGN PATENT DOCUMENTS

| | | | |
|---|---|---|---|
| EP | 0454890 | A1 | 11/1991 |
| EP | 0738550 | A2 | 10/1996 |
| EP | 0970766 | A2 | 1/2000 |
| EP | 1068931 | A2 | 1/2000 |

* cited by examiner

PLACING TOOL WITH MEANS FOR CONTROLLING PLACING PROCESSES

BACKGROUND OF THE INVENTION

1. Field of the Invention

The invention relates to a setting tool having means for monitoring setting operations.

2. Description of Related Art

Setting tools having means for monitoring the setting operation are known.

For example, in DE 44 01 134, a method is described in which a force component is measured over the distance of the stroke and compared with a desired curve. The intention is to monitor whether the setting operation has been carried out properly.

EP 0 738 551 (U.S. Pat. No. 5,666,710) discloses an apparatus for checking the setting of blind rivets. Here, the tensile force and the position of the draw shaft are measured. The energy converted is determined via an integrator and compared with a desired value.

The disadvantage with these known means for monitoring the setting operation is that, although it is possible to determine with a certain probability whether the setting operation lies within a given tolerance limit, the cause of a fault cannot be determined. During a setting operation, a whole series of faults can arise. For example, errors made by the operator, for example as a result of skewed placement of the setting implement, excessively wide holes, wrong rivets, faults in the rivet itself. In the case of blind rivets, there is also always the risk that the rivet will grip only the part to be fixed but not the counterpart.

BRIEF SUMMARY OF THE INVENTION

It is an object of the invention to provide a setting implement which monitors the setting operation and, in the process, also detects the cause of a fault that occurs. Furthermore, it is an object of the invention to permit comprehensive monitoring of various parameters of a setting operation.

This object is already achieved in a surprisingly simple way by a setting tool according to the features of claim 1. According to said claim, a setting tool comprising a head piece, in particular for holding the rivet, a device for gripping and/or pulling and a pulling apparatus connected to the device for gripping and/or pulling is provided, which has means for measuring the variable values occurring during the setting operation, a device for comparing the measured values with stored values and also a device for determining a cause, in particular a cause of a fault, for the deviation of measured from stored values.

The setting tool, which can be of an extremely wide range of types, for example rivet setting tools, blind rivet nut setting tools, locking ring bolt setting tools, has sensors. By means of the sensors, various parameters such as the position of the pulling apparatus, the time since the start of the setting operation or the tension exerted can be measured. These measured values are compared with stored values. The stored values contain not only a desired curve, a faulty setting operation being assumed if it is not complied with, but also values for specific faults. These values can be available as a simple individual value or else as a desired curve with various parameters which describe a specific fault. The set of stored causes of faults comprises at least one cause of a fault, which may already be sufficient in some applications. Preferably, however, a plurality of different causes of faults is stored. In addition to faults, the cause of deviations which, although they lie within the tolerance band, are not ideal, can also be determined. In this case, the setting implement is preprogrammed for a quite specific setting operation which, for example, is defined by the rivet used, the material used and its thickness. Programming for a plurality of different setting operations is also conceivable. The invention makes it possible to correct the cause of the fault as quickly as possible. Since operating errors are also registered with the invention, the setting implement is also very well suited to untrained operators. By means of the invention, the quality of each setting operation can be monitored. This is of great advantage, for example, in aircraft engineering. There, although use is made to some extent of rivets which have been subjected to x-ray inspection, it is not possible to ensure by means of the inspection whether the riveting operation has then proceeded without fault. Using the invention, it would in theory even be possible to dispense with the complicated x-ray inspection and nevertheless to be able to guarantee the durability of the riveted connection.

Preferred embodiments and developments of the invention can be gathered from the respective subclaims.

In a preferred embodiment of the invention, the measured variable values comprise the tension exerted by the pulling apparatus and/or the position of the pulling apparatus and/or the time since the start of the respective setting operation and/or the angle with respect to the surface on which the setting implement is placed. By means of these values, comprehensive fault diagnosis is possible. This can also be carried out by converting the values into curves or multidimensional characteristic maps.

In a preferred embodiment of the invention, monitoring is carried out as to whether the implement has been placed at the correct angle. The operators frequently do not place the setting implement accurately at the correct angle. As a result, there is a reduction in the strength of the connection.

It is expedient also to monitor whether a wrong rivet has been used. For example, there are also rivets which do not differ visually but consist of different material and therefore have a completely different strength. This can be determined, for example, by means of the curve of the tension exerted by the pulling apparatus.

With a further embodiment, monitoring is carried out as to whether the rivet is damaged. For example, material faults in the rivet lead to a different force curve.

A further embodiment monitors whether the hole provided for the rivet is too wide or too narrow.

Also, whether there is a rivet in the implement can easily be determined by the setting tool according to the invention, for example by measuring the tension exerted.

It is particularly expedient to monitor whether the rivet is gripping both parts to be connected. Particularly in the case of blind rivets, it frequently occurs that the rivet does not grip both parts to be connected. The operator cannot monitor this himself either, since he sees only the part to be fixed but not the other side. If the rivet grips only the part to be set, the tension exerted by the pulling apparatus rises later, for example at a greater stroke. The fault can easily be determined in this way.

In a further embodiment of the invention, monitoring is carried out as to whether the setting tool has a defect. For example, the oil level of the pulling apparatus can be too low. Consequently, the pulling apparatus becomes stiff and no longer operates with the envisaged tensile force.

Ideally, a plurality of these causes of faults is programmed into an implement. The programming of the implement can be carried out by performing a series of tests, in which faults are made deliberately. The deviations of the measured values occurring in the case of the respective faults can then be stored in the implement, in order to be compared with values measured later. It is also conceivable not only to perform pure fault monitoring but also to compare the deviation of a setting operation still lying in the respective tolerance area with an ideal value.

A preferred embodiment of the invention has a device for measuring the position of the pulling apparatus and/or for measuring the tension exerted by the pulling apparatus. The position of the pulling apparatus and the tension exerted are two of the most important parameters via which a whole series of causes of faults can be determined.

As provided in an expedient embodiment of the invention, the tension exerted by the pulling apparatus is measured with a strain gage. Such a strain gage for measuring stresses is reliable and inexpensive. The tension is substantially proportional to the tensile force exerted by the pulling apparatus.

In an alternative embodiment, the device for measuring the tension exerted by the pulling apparatus comprises a piezoelectric sensor. This piezoelectric sensor needs no voltage supply.

In order to measure the position of the pulling apparatus, an expedient embodiment of the invention comprises a capacitive sensor. Such a capacitive sensor is substantially more accurate as compared with optical sensors frequently used.

In one development of the invention, the angle with respect to the surface on which the setting implement is placed is measured by means of at least three sensors arranged on the implement head. These sensors contact the surface on which the implement is placed if it is placed at the correct angle. In this way, a frequent error made by the operator can be diagnosed.

In one development of the invention, the setting tool has means for data storage and/or further processing. For example, the measured values can be evaluated statistically. The user can, for example, monitor accurately how many setting operations have been made, how many of these were faulty and what causes there were for faults. Furthermore, it is conceivable to evaluate the values of the setting operations which have proceeded correctly, for example in the form in which deviations of the values from the ideal values are stored and evaluated. In this way, comprehensive quality control is possible.

The manufacturer of the tool can monitor the function of his implement. It is also conceivable that the tool is not paid for per se but that the manufacturer makes the tool available to the customer and the latter then pays, for example, according to the number of setting operations carried out. In addition, to grant a manufacturer guarantee, it is extremely advantageous if the manufacturer can detect potential faults through the tool itself and, if appropriate, exclude them.

In an expedient embodiment of the invention, the means for data storage and further processing can be reset, in particular during an implement service. In this way, for example, the implement can be issued to the customer like a new implement after being reset.

An expedient embodiment of the invention has a chip for the comparison of measured and stored values and/or for the data storage and further processing. Such a chip can be tailored exactly to the requirements of the implement. Furthermore, the smallest possible overall size is thus possible. As compared with EPROMs, which can also be used, the chip additionally offers the advantage that it is substantially more difficult to manipulate.

In an expedient embodiment of the invention, the comparison of measured and stored values and/or the data storage and further processing are carried out in the implement. By means of modern microelectronics it is possible to integrate the entire evaluation into a handheld implement.

An independent power source, in particular a rechargeable battery, is expediently provided in the implement for the means for comparing measured and stored values and/or for the data storage and further processing. In this way it is ensured that stored measured values are not lost, even in the event of a relatively long power failure.

The setting implement expediently has a counter which counts rivet setting cycles and/or faults and/or causes of faults. In this way, statistical fault evaluation is even possible with the implement itself.

In a development of the invention, the setting implement has a device for registering the date and/or time of day. In this way, the setting operations and possible faults can be assigned to a specific time. It is thus possible subsequently to understand when and as a result often also where exactly a specific fault has occurred.

A development of the invention has a device for transmitting measured values to an external unit. Conceivable as an external unit is, for example, a computer system, by which further storage and evaluation of the measured values supplied by the setting implement can be performed. The individual setting implements could, for example, be assigned to the system via their implement numbers.

The device for transmitting measured values expediently has a device for transmitting infrared, ultrasound or radio signals, in particular "Bluetooth". Thus, for example with Bluetooth technology, there is an inexpensive and reliable standard component for wire-free transmission.

As an alternative to this, the external unit can comprise a mobile radio terminal. Thus, wire-free transmission is possible even over long distances, for example to the manufacturer of the setting implement.

In an expedient embodiment of the invention, the setting tool has a device for switching off the rivet setting implement and/or indicating the cause of a fault in response to a signal generated in the event of a faulty rivet setting operation. Thus, for example, it is also possible not to carry out a setting operation at all if a fault is indicated from the start. If the device is not placed at the correct angle, it does not trigger at all; likewise, if there is no rivet in the implement. Even if, when setting a blind rivet, only the component to be fixed is gripped, aborting the setting operation is still possible, while indicating the cause of a fault.

It is also conceivable to generate the signal by means of an external unit, for example a connected computer.

In a development of the invention, the setting tool can also contain a device for connection to a local network, which means that faster transmission and further processing of the data are possible. Within the context of mounting steps following one another, for example on the production line assembly, rapid reporting of a fault is particularly advantageous, in order that the entire mounting process does not falter for a long time.

The pulling apparatus of the setting implement can be operated electrically, in particular with a rechargeable battery, electrohydraulically, hydraulically or hydropneumatically. It is also possible to provide a fully cordless implement with a rechargeable battery and wire-free data transmission.

In a development of the invention of a non-cordless implement, the setting implement has a line for the supply of compressed air or power and at least one further line for the transmission of the measured values, and the further line, together with the one line, forms one strand with one connection. Thus, it is not necessary for two lines to be connected for power supply and data interchange. It is conceivable to provide a combined connector with, for example, a compressed air line and adjacent lines for the data transmission.

In one development of the invention, the setting tool carries out a test cycle after being switched on. In this way, faults which relate to the implement can be ruled out even before use. For instance, in order to monitor whether the tool is in order mechanically, the pulling apparatus can be moved forward and back automatically after being switched on. In the event of stiffness of the pulling apparatus, the tool indicates the fault.

The object of the invention is also achieved by a method for monitoring setting operations, in particular rivet setting operations, according to the features of claim 28.

According to said claim, a part to be set is inserted into a setting implement, preferably a setting implement as described above, and then a tensile force is exerted on the part to be set by means of a pulling apparatus.

The values which occur during the setting operation are measured. The values measured in this way are compared with stored values. Finally, by using this comparison, the cause of a deviation of measured from stored values is determined from a set of stored causes.

Furthermore, the invention according to the features of claim 38 relates to a head piece for a setting tool, comprising means for measuring the variable values occurring during the setting operation, comprising a device for comparing the measured values with stored values and also comprising a device for determining the cause of the deviation of the measured from the stored value from a set of stored causes. This head piece fulfills the task according to the invention just like the setting implement. A head piece makes it possible to equip an existing setting implement with the functions according to the invention.

Furthermore, the invention relates to a setting tool comprising a piezoelectric sensor and a method for setting parts to be set, preferably rivets, in particular an apparatus and a method for setting rivets with tension measurement, and also a head piece for a setting tool.

Riveted connections are used in industrial fabrication in many ways for joining components. In particular in the automobile and aircraft industry, under the aspect of safety, high requirements are placed on the stability and long-term loadbearing ability of subassemblies. The stability of a riveted connection depends to a critical extent on the progress of the riveting operation. For example, if the early pin of a blind rivet shears off too easily, the strength and durability of the riveted connection is endangered or at least not optimal. This is similarly true, for example, if the blind rivets have not been inserted straight into the opening in the metal sheets, or the opening for the rivet is not matched optimally. The latter occurs, for example, as a result of non-round openings or those with wrong diameters.

Known riveting tools set rivets with preset parameters, such as the tensile force to be applied. Under optimum conditions, a rivet setting operation using such an implement may likewise lead to an optimum result, but deviations from the desired parameters, which influence the strength of the connection, are not recognized in this case. This is important in particular, since a defective riveted connection under external checking can quite possibly give the impression of a correctly set blind rivet or a riveted nut. Such faulty connections have detrimental effects on the quality of the subassemblies produced therewith and, in regions that are sensitive with respect to safety, such as aircraft construction, can even have fatal consequences.

EP 0 454 890 discloses a rivet setting implement which is provided with a force measuring device which ensures that the rivet setting implement operates with a predefined tensile force. The force measuring device has a strain gage. The disadvantage with such a strain gage is that a power supply is needed for this and that the strain gage does not intrinsically convert the tensile force into a voltage signal.

The present invention has therefore taken the object of providing improved monitoring of riveted connections during rivet setting. This object is already achieved in an extremely surprisingly simple manner by a setting tool and by a method for setting and by a head piece for a setting tool. Advantageous developments are specified in the respective dependent claims.

Accordingly, a rivet processing tool, in particular a rivet setting tool, having a head piece for holding a rivet, in particular, a device for gripping and/or pulling a rivet pin, in particular, and a pulling apparatus connected to the device for gripping and/or pulling a rivet pin, in particular, is provided which, in addition, has a device comprising at least one piezoelectric sensor for measuring the tension of the pulling apparatus.

By means of the device for measuring the tension of the pulling apparatus, the measured values of the latter can be determined and evaluated. It has been shown that a measurement of the tension variation during a rivet setting cycle reproduces detailed information about the rivet setting operation and, in particular, faulty rivet setting operations can be determined by using the tension variation.

The piezoelectric sensor used for the measurement of the is tension is inexpensive, supplies exact measured values and can be accommodated in an extremely small space.

Furthermore, such a sensor supplies a voltage signal. Thus, as distinct from the strain gages conventionally used, a power supply is not required.

The invention is suitable for all types of rivet processing and setting tools, for example including rivet setting tools, blind rivet nut setting tools, locking ring bolt setting tools, etc.

For the monitoring of the setting operation, additional parameters can be recorded. For example, the instantaneous position of the pulling apparatus can advantageously be determined by a device for determining the position of the pulling apparatus, such as a displacement transducer, so that it is possible to evaluate tension-displacement value pairs.

The tension can be measured indirectly in a straightforward manner by means of a pressure sensor which, for example, measures the opposing force exerted by the pulling apparatus on a part of the rivet setting tool.

In particular for industrial applications, hydraulically operated pulling apparatuses are advantageous, with which fast setting cycles with reproducible setting parameters can be carried out. However, the invention also comprises electrical, electrohydraulic and hydropneumatic pulling apparatuses. Among the electrical pulling apparatuses, a cordless implement with integrated rechargeable battery is particularly advantageous.

For registering and evaluating the tension measured values from the device for measuring the tension of the pulling apparatus, an appropriate device can advantageously be accommodated in the setting implement. Furthermore, a counter which counts setting cycles can be accommodated in the setting implement. By using a counter which records the number of setting cycles carried out by using the tension measured values, maintenance intervals can be monitored, for example. In addition, the counter can be used for the purpose of monitoring whether any rivets have possibly been left out, in particular in the case of large subassemblies with a large number of rivets.

The device for evaluating and registering can also comprise a date and/or time registering device. For example, by means of date registration, guarantee periods and maintenance periods can be checked. The implement can be set up, for example, in such a way that it starts the date registration after a certain number of rivet setting cycles, so that sample cycles can be carried out before the start of the date registration, for example. With additional registration of the time of day, it is possible, for example, to trace back the time at which faulty rivets were set.

The tension measured values and/or the counter readings can also be transmitted to an external unit by an appropriate device for the transmission of tension measured values. This unit can be, for example, a computer for the data evaluation and/or control. The signal transmission can advantageously in this case be accomplished by a device for transmitting infrared, ultrasound or radio signals.

Furthermore, the data can also be transmitted via a mobile radio network to a mobile radio terminal. By means of this the data can be transmitted directly to a maintenance department or to the manufacturer, for example for remote diagnoses in the event of faulty functioning of the implement. Likewise, the manufacturer can consequently check whether the required maintenance intervals have been complied with.

The device for gripping a rivet pin preferably additionally comprises clamping jaws which are actuated via a chuck connected to a draw spindle. The tension is in this case transmitted via a draw spindle.

The setting implement can also be provided with a device for connection to a local network for faster distribution of the data to a plurality of external evaluation units.

It is also within the scope of the invention to specify an appropriate method of monitoring setting operations which, in particular, can be carried out with a setting implement according to the invention. The method provides for a part to be set to be inserted into an opening provided for the purpose and then, in order to set the part to be set, for a tensile force to be exerted on the part to be set, preferably the rivet pin, by means of a pulling apparatus, during the application of the tensile force at least one measured value being obtained which is caused or influenced by the tensile force applied to the rivet pin. The measured value can in this case be obtained at a predetermined time or stroke of the pulling apparatus and in this way can supply information about any rivets not set optimally.

It is preferable for a plurality of measured values to be obtained at regular time intervals during the application of the tensile force. Therefore, a time profile of the tensile force expended can be determined and in this way detailed information about the riveted connections can be obtained.

The use of measured data obtained with a piezoelectric pressure sensor is particularly advantageous. Under the high tensile forces which occur, even extremely small sensors supply sufficiently high voltages for measurements which are precise and not susceptible to interference.

Finally, the invention relates to a head piece for a setting tool, which comprises a device comprising at least one piezoelectric sensor for measuring the tension exerted by the pulling apparatus. In terms of its function, the device required for measuring the tension, together with a piezoelectric sensor, is integrated completely into the head piece. In this way it is possible to provide a head piece with the function according to the invention for an existing setting implement. This has the advantage that no complete setting implement has to be bought. The head piece can be provided with appropriate connections for setting tools from different manufacturers. In this case, it is to the advantage of the head piece according to the invention that the piezoelectric sensor does not need any power supply.

Finally, the invention relates to a rivet. The setting implement according to the invention according to the features of claim 1 depends on uniformity of the setting operations when comparing measured values, such as the tension at a specific time in the setting operation. In this case, it is above all rivets which have different characteristics which are disadvantageous. If the characteristics are very different, for example because of different materials or because of fabrication tolerances, the implement cannot be programmed optimally. It is then necessary for the tolerance limit for a setting operation to be increased as well, which is in turn disadvantageous for an optimal setting result. It was therefore also an object of the invention to provide a rivet which has substantially constant characteristics.

This object is achieved in a surprisingly simple way by a method for monitoring a rivet. A tension is applied to the rivet, in particular using the setting tool, the change in length of the rivet is measured and is compared with a desired value. In order not to damage the rivet, the measurement is performed in the elastic range. By using a desired value of the length change or a distance/force curve, it is possible to test whether the rivet has the intended characteristics.

In a preferred development of the invention, the tension is applied to the rivet pin of a blind rivet.

In a development of the invention, rivets which do not lie within a predefined tolerance band are separated out. The separation can be carried out automatically by the monitoring apparatus.

In a development of the invention, rivets which lie within a predefined tolerance band are marked permanently. Thus, the quality check carried out is visible on the rivet. Confusion with untested rivets is ruled out in this way.

BRIEF DESCRIPTION OF THE SEVERAL VIEWS OF THE DRAWINGS

The invention is to be explained in more detail below using preferred exemplary embodiments and with reference to the appended drawings, identical designations in the individual drawings referring to identical or similar components.

DETAILED DESCRIPTION OF THE INVENTION

In the following description, reference will primarily be made to the rivet setting operation; this means the setting of a rivet. In this case, however, the rivet setting described comprises the setting of blind rivets, riveted nuts and, in particular, also the setting of locking ring bolts, even if this is no longer expressly mentioned. To the extent that a different head piece, mouthpiece, chuck or another holder is needed for the respective embodiment, those skilled in the art in this field can make appropriate adaptations to the current requirements.

Figure 1:
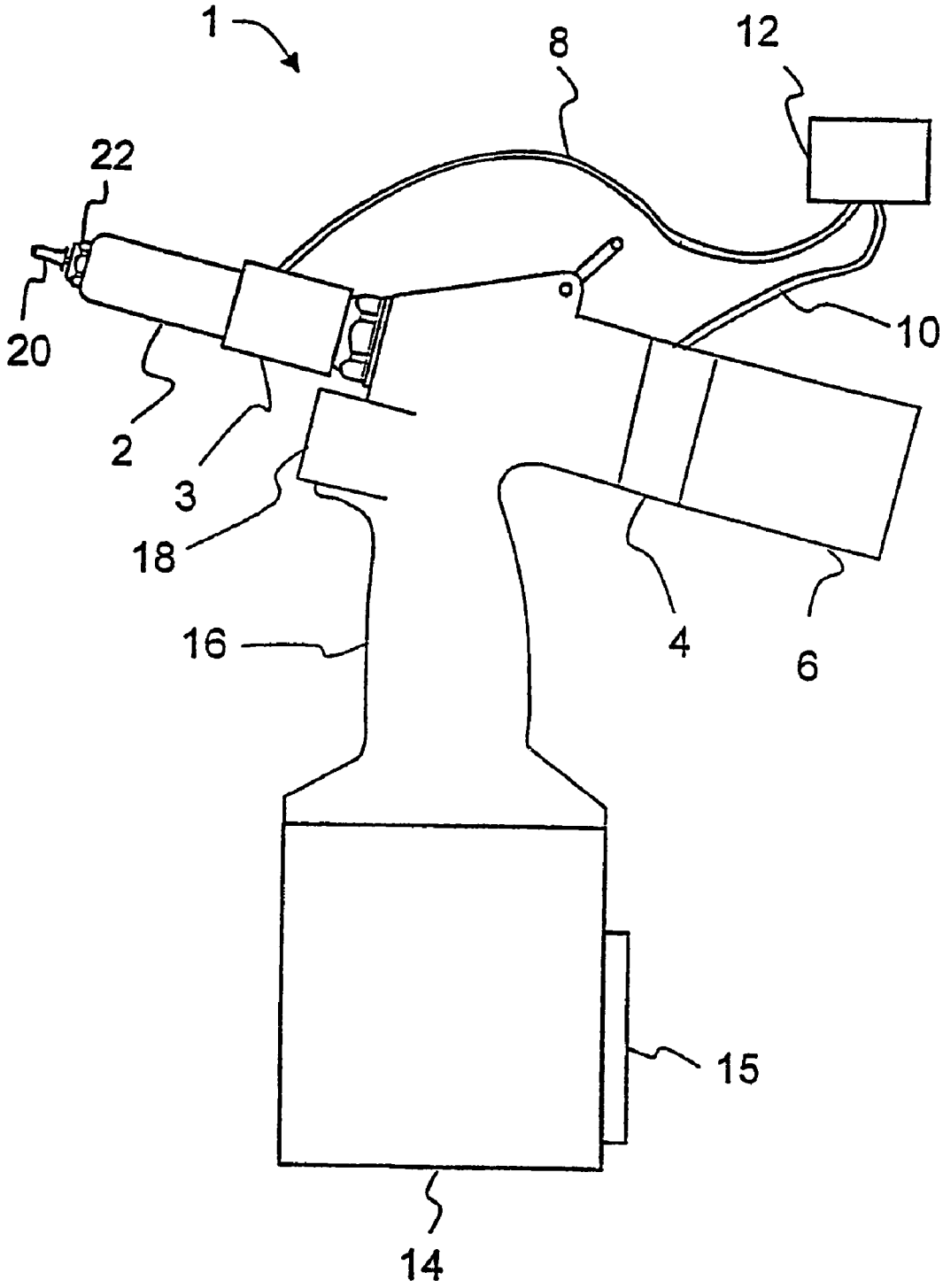
FIG. 1 shows a schematic view of a first embodiment of the invention.

FIG. 1 shows a schematic view of a first embodiment of the rivet setting implement according to the invention. The rivet setting implement 1 comprises a head piece 2 with adjusting nut 22 for holding a rivet 20, a body part 6 and a handle 16. Using a manually actuated triggering device 18, a pulling apparatus in the interior of the rivet setting implement is triggered, being connected to a device for gripping the shank or the pin of the rivet 20, so that the pin is pulled into the implement. In this case, the device for gripping the shank or rivet pin preferably comprises a chuck having two or more clamping jaws. The pulling apparatus is supported on the head part 2 of the rivet setting implement, so that the tension exerted on the rivet pin is transformed into a pressure exerted between head part and pulling apparatus. On the head part 2 there is a sensor unit 3, preferably with piezoelectric sensor, which measures the pressure arising between head part 2 and pulling apparatus as the rivet pin is pulled. The sensor generates a voltage signal substantially proportional to the tension. This voltage is either transmitted directly via a cable 8 to an external device 12 for registering and evaluating tension measured values or is initially amplified by the sensor unit, the amplified signal then being transmitted.

In addition, dedicated evaluation electronics 15 which, for example, comprise counting electronics with a date and/or time of day function, can be accommodated on a part 14 fixed to the handle.

As an alternative to a transmission via cable connections, the transmission to an external evaluation unit can also be carried out by appropriate devices for the transmission and reception of infrared, ultrasound or radio signals. In particular, the rivet setting implement can also be set up to transmit the signals via a mobile radio network to a terminal, by which means large distances between rivet setting implement and external evaluation unit can be attained.

In this embodiment, the rivet setting implement 1 also further has a displacement transducer 4, which determines the instantaneous position of the pulling apparatus via a device for measuring the position of the pulling apparatus, and sends a corresponding signal to the external device 12 via a cable connection 10. The displacement transducer can be, for example, an optoelectronic or else an inductive displacement transducer.

Figure 2:
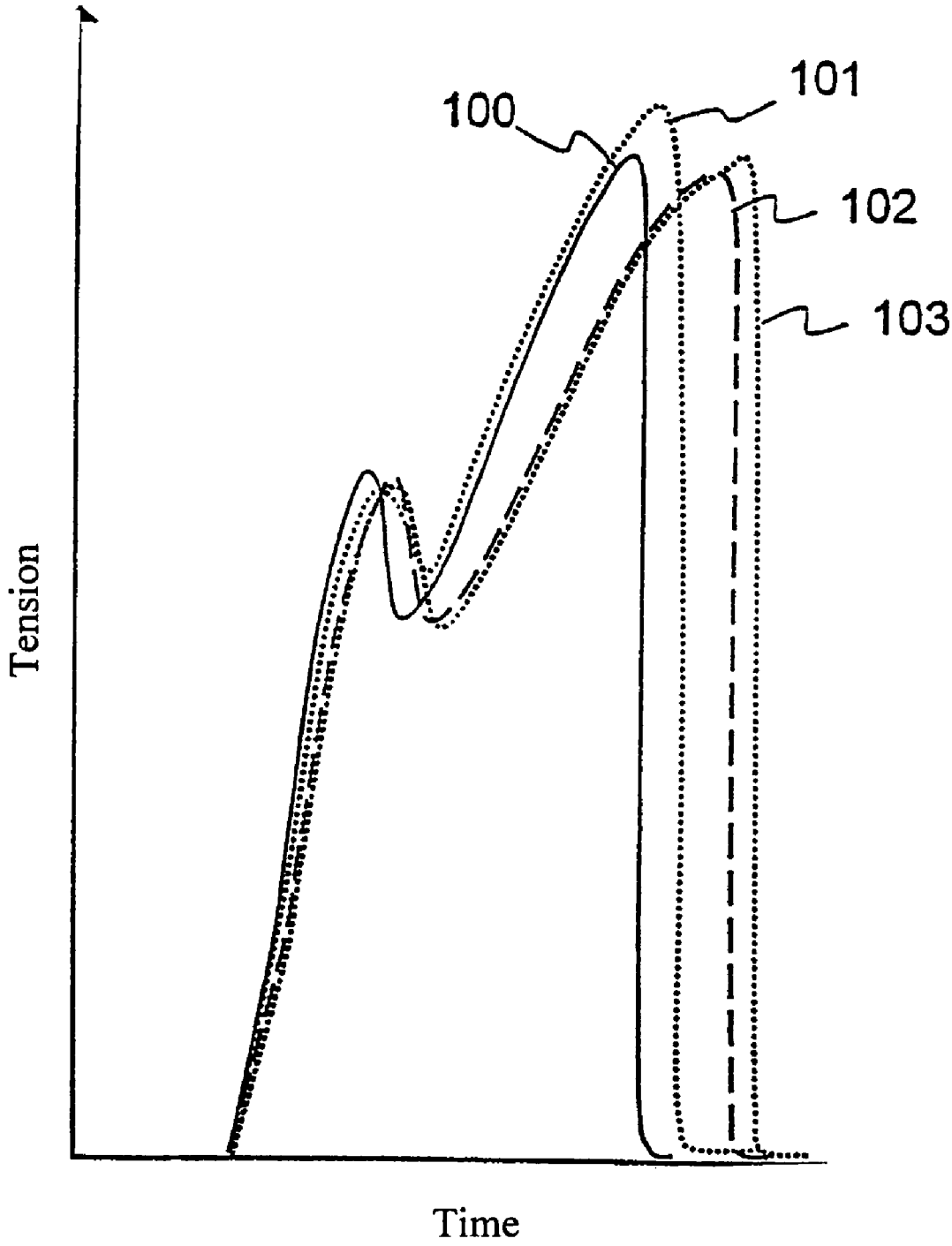
FIG. 2 shows graphs of the tension as a function of time.

FIG. 2 shows graphs of the tension as a function of time in the course of rivet setting cycles. Here, graph 100 shows the typical curve of the tension under optimum conditions. The curve exhibits a minimum of the tension. As far as this minimum, the rivet head is compressed by the tensile force exerted by the pulling apparatus of the rivet setting implement. After that, the tensile force increases again until the rivet pin shears off and the tension falls abruptly to zero.

Graphs 101, 102 and 103 show curves of the tension under non-optimal conditions. Here, graph 101 shows the curve of the tension in the case of an excessively large hole diameter. In this case, the minimum between the two maxima is not as low as in the optimum case and has a somewhat later time. Up to the point where the pin shears off, in the case of an excessively large hole diameter, a higher tension additionally has to be applied and the pin shears off at a somewhat later time.

Graph 102 shows the curve of the tension in the case of a rivet not inserted completely into a hole, and graph 103 in the case of a riveting operation without material, that is to say without a rivet having been plugged into a hole in a metal sheet. In both cases, the minimum of the tension and the time at which the pin shears off are located at a later time as compared with the course of the curve under optimum conditions.

By using these graphs, it becomes clear that the curve of the tension over time can give detailed information about the state of the set rivet.

In the following text, reference will be made to FIGS. 3A to 3D, which show embodiments of external devices for registering and evaluating tension measured values of the invention.

Figure 3A:
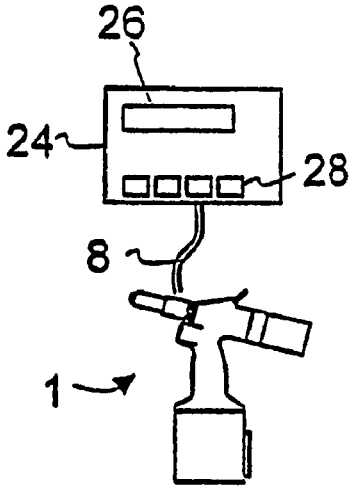
FIGS. 3A to 3D show various embodiments of external devices for the registration and evaluation of tension measured values.

In FIG. 3A, an evaluation unit 24 which is connected via a cable connection 8 to the sensor unit 3 of the rivet setting implement 1 is shown schematically. Instead of the cable connection 8, the sensor unit and the evaluation unit could also be connected to each other via a transmitting/receiving device for infrared, ultrasound or radio signals, the sensor being equipped appropriately with a transmitter and/or receiver.

The evaluation unit 24 comprises an LCD display 26 and operating elements 28. Current results of measurements are shown on the LCD display, such as the maximum tension reached. The measured and evaluated results are determined by suitable measurement electronics in the unit 24. Via the operating elements, various functions, such as performing a reference measurement, threshold values for warning messages or resetting the current measured values, can be entered.

Figure 3B:
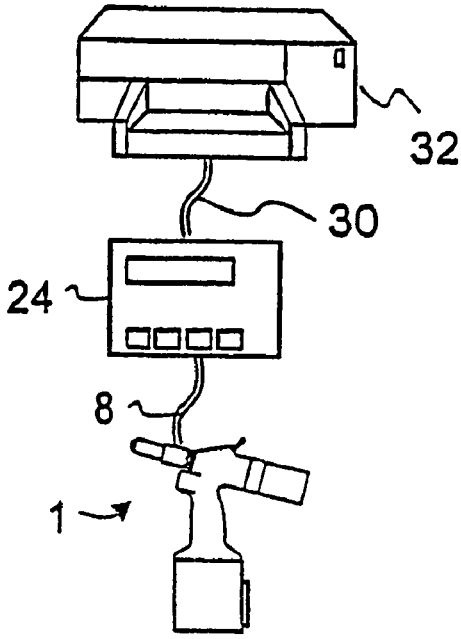

FIG. 3B shows an expansion of this system, a printer 32 being connected to the evaluation unit 24 via a cable connection 30. Via the printer 32, current measuring results and further data can be output. The printer can be driven, for example, via the operating elements 28.

Figure 3C:
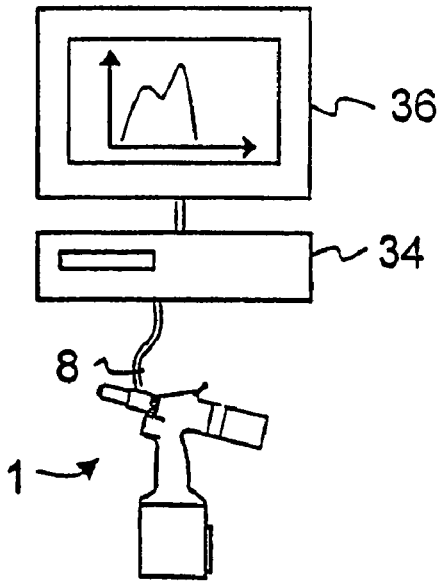

FIG. 3C shows an embodiment in which the measured values from the sensor unit 3 of the rivet setting implement are transmitted via a cable connection 8 to a computer 34 as evaluation unit. For this purpose, the computer, preferably a workstation computer, can be provided with a suitable plug-in board in which the evaluation electronics for the voltage measured values transmitted are accommodated. For instance, the voltage measured values are digitized at regular time intervals by means of an ADC module and can then be further processed via suitable software. The conditioned measured data and evaluation results are then displayed on the monitor 36 of the computer.

Figure 3D:
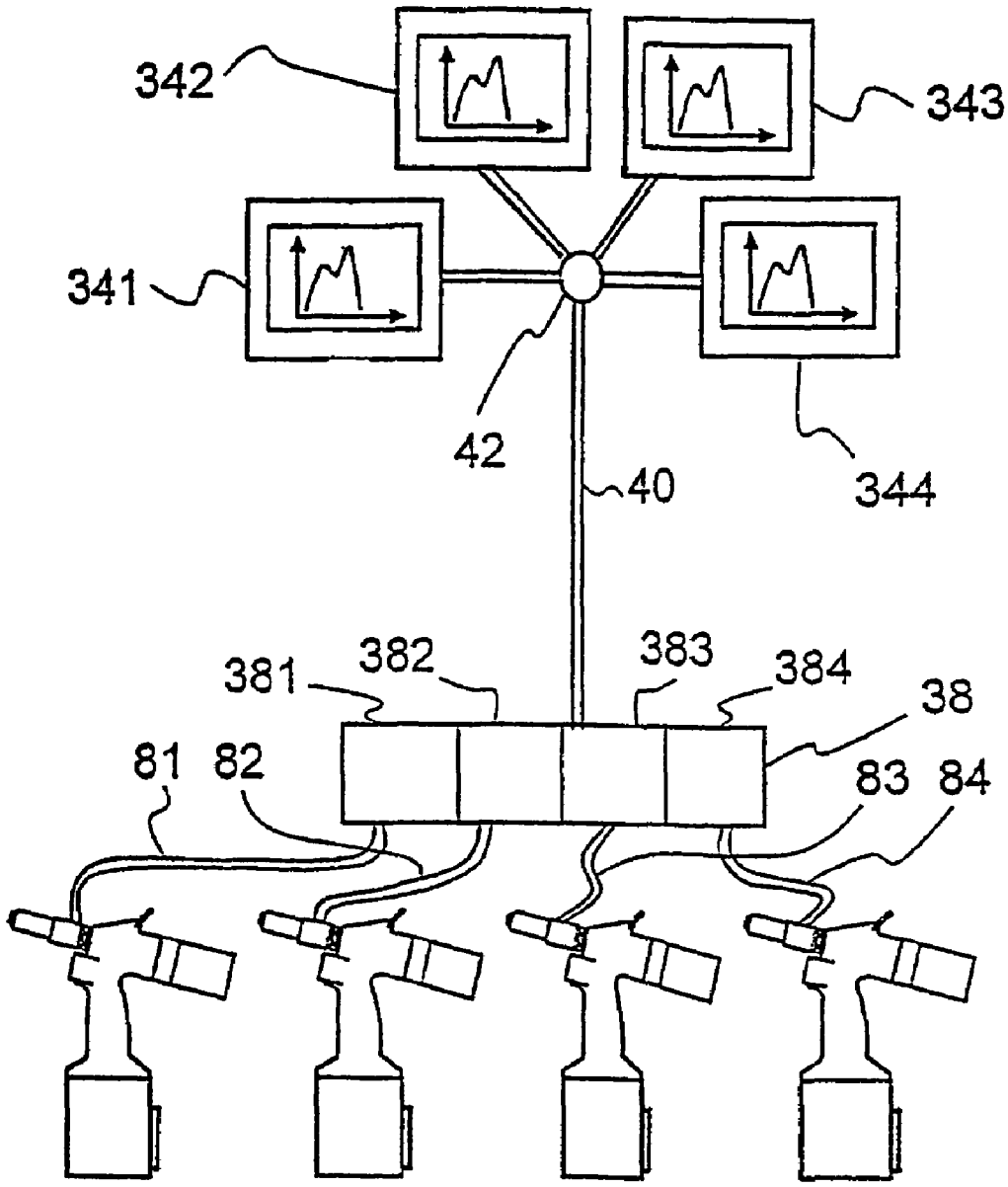

FIG. 3D shows a further embodiment, in which a plurality of rivet setting implements is connected to an evaluation unit 38 via cable connections 81, 82, 83 and 84. The embodiment is shown by way of example in FIG. 3D for four rivet setting implements. However, this structure can be expanded to as many implements as desired. The structure can also likewise be used for an individual rivet setting implement. Each rivet setting implement is connected via the cable connections to one of the blocks 381 to 384 of the evaluation unit 38.

The evaluation unit 38 is in turn connected via a connection 40 to a network node 42, from which the data can be distributed to a plurality of computers 341 to 344.

Figure 4:
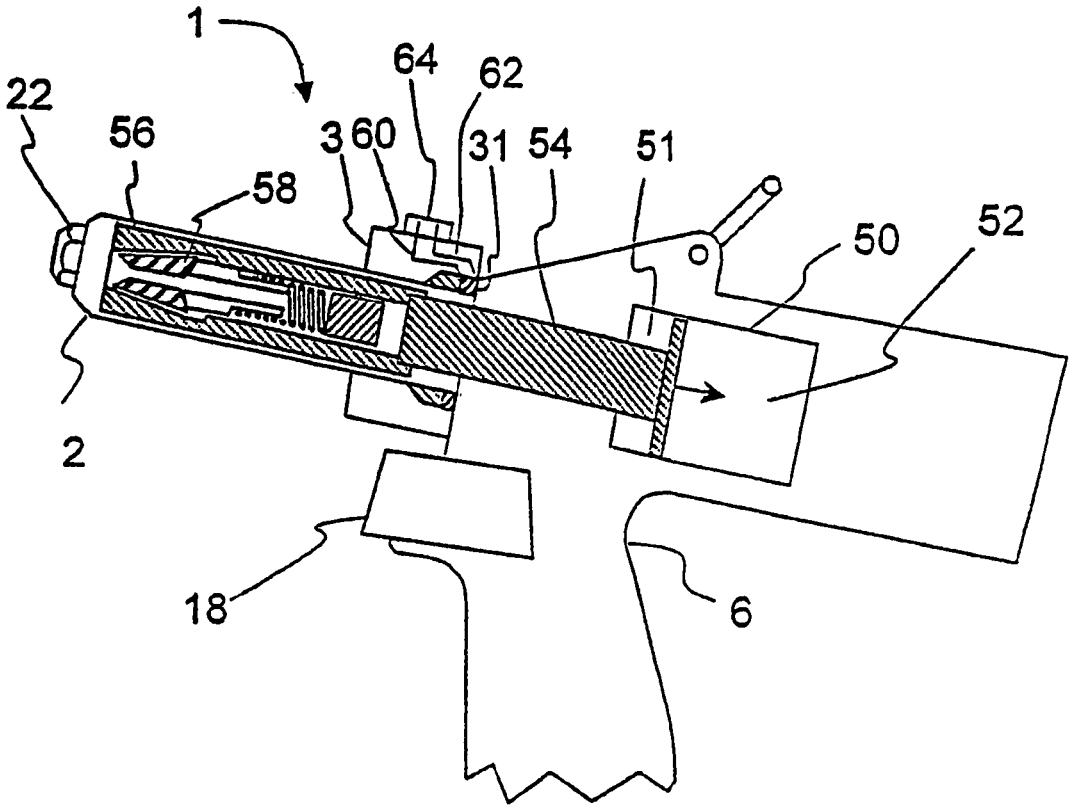
FIG. 4 shows a schematic cross-sectional view through one embodiment of the invention.

FIG. 4 shows a schematic cross-sectional view through an embodiment of the invention, by using which the principle of the tension measurement can be explained. In the body part 6 there is a hydraulic cylinder 50. In the cylinder 60 there runs a hydraulic piston 52, to which a draw spindle 54 is fixed which transmits the force exerted by the piston to a chuck 56 fixed thereto. If a force is exerted by the piston in the direction of the arrow, by a suitable hydraulic fluid being forced into the cylinder section 51, clamping jaws 58 are initially compressed by the chuck 58 moving rearward until a rivet pin located between them is gripped and clamped in. The clamping jaws then pull the rivet pin further into the head part 2 of the rivet setting implement until it shears off the rivet head resting on the adjusting nut 22. The piston can also be operated hydropneumatically, the hydraulic fluid being forced into the hydraulic cylinder 50 by a further, pneumatically operated piston which, for example, can be accommodated in the part 14 shown in FIG. 1 and fixed to the handle.

As a result of the tensile force exerted via the chuck 56, a pressure is exerted on the head part 2. The head part 2 is fixed to the body part 6 in such a way that the pressure is not transmitted directly to the sleeve of the head part 2 but via a piezoelectric material part 31 located between head part and body part. A piezoelectric voltage produced as a result can then be transmitted by means of the electrical connections 60 and 62 to a suitable connecting plug 64. Likewise, the pressure sensor can also be connected to suitable measuring and evaluation electronics, which are integrated in the rivet setting implement itself.

Figure 5:
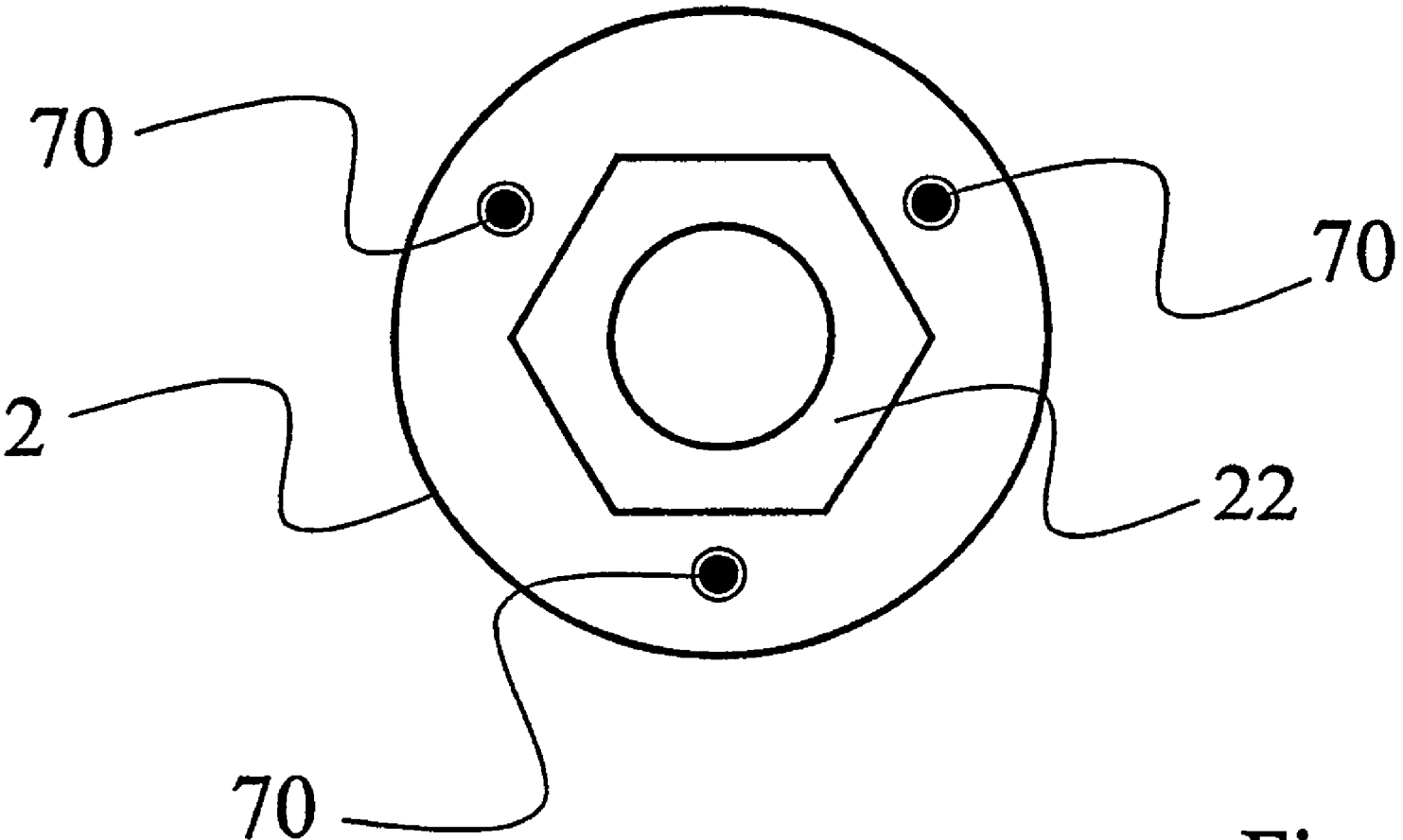
FIG. 5 shows a schematic view of a head piece of a setting implement having sensors.

FIG. 5 shows a schematic plan view of a head piece for a setting tool according to the invention. It is possible to see the adjusting nut 22 of the head piece 2. Three sensors 70 are fitted around the adjusting nut 22. When the implement is placed, all three sensors make contact with the part to be fixed only if the implement is at the correct angle with respect to the part to be fixed. In this way, it is possible to monitor whether the operator is making an error. If the implement is not placed at the correct angle, an electronics unit ensures that the implement is blocked, and the setting operation therefore cannot be started at all.

Figure 6:
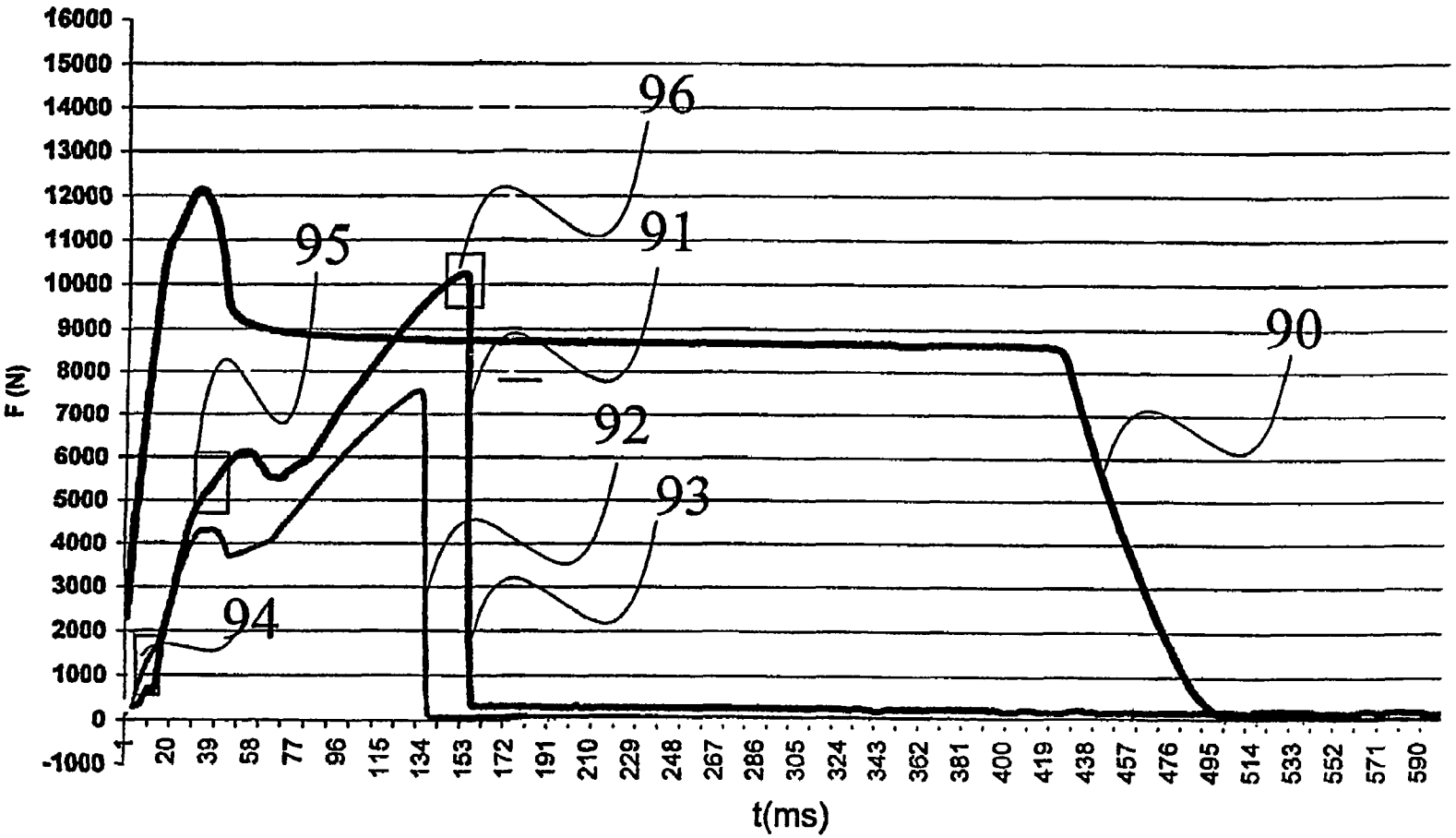
FIG. 6 shows graphs of the tension of various set items as a function of time.

FIG. 6 shows four graphs, in which the tension exerted during a setting operation is plotted against the time, the x-axis indicating the time and the y-axis indicating the force. Graph 90 shows the force-time curve when setting a rivet nut.

Here, the force initially rises sharply in the elastic region, changes into the plastic region and remains approximately constant as far as the end of the setting operation. Graphs 91, 92 and 93 show the force-time curve for various blind rivets. Here, the force also rises in the region of plastic deformation, until the rivet pin shears off and the force falls to zero. It can be seen that the force-time curves for different rivets are very different. It is therefore necessary to program the implement for specific setting operations. By using deviations from these curves, a series of causes of faults can already be detected. For instance, in the case of a blind rivet, if the force rises later in the elastic region, the blind rivet has gripped only the part to be set. If the hole is too wide, the curve rises less steeply in the plastic region. In this way, by means of a comparison with stored causes of faults, a whole series of faults can be detected. It is likewise conceivable to measure a force-distance curve or even a force-time and a force-distance curve. By means of evaluating setting operations carried out, ideal values and typical deviations in the case of specific causes of faults can be determined accurately. The evaluation can be carried out by setting various reference fields 94, 95, 96. If the curve runs past the field 94 on the right, then the blind rivet is gripping only the part to be fixed; if the change from the elastic into the plastic region does not take place exactly in field 95, then the drilled hole is too wide or, if the tension does not fall to zero in field 96, a wrong rivet has been used. Accurate fault analysis is carried out by means of many such fields, which are traversed during the setting operation and make it possible to detect a cause of a fault. By means of lining up individual fields, if the desired values are complied with, specific causes of faults are also ruled out. If, for example, field 94 is complied with, the fact that the counterpart has not been gripped is ruled out. In this way, unambiguous allocation of the various causes of faults is possible.

The invention claimed is:

1. A rivet placing tool comprising:

a head piece for admission of a rivet;

a mechanism for seizing and/or pulling a riveting bolt;

hauling equipment connected to said mechanism for seizing and/or pulling;

means for measuring values occurring with the rivet placing tool;

a mechanism for comparing said measured values with stored values; and a mechanism for the determination of a cause of a deviation of said measured values from said stored values from a quantity of stored causes.

2. A setting tool comprising a head piece for holding a rivet;

a gripping device for gripping and/or pulling the rivet;

a pulling apparatus connected to the gripping device so that the rivet can be set in a surface;

a measuring device for measuring a measured value from said pulling apparatus; and a processor for comparing said measured value with a stored value, said processor determining a cause of a deviation of said measured value from said stored value from a set of stored causes.

3. The setting tool as in claim 2, wherein said measured value comprises a value selected from the group consisting of a tension exerted by said pulling apparatus, a position of said pulling apparatus, an elapsed time, an angle of the setting tool to the surface, and any combinations thereof.

4. The setting tool as in claim 2, wherein said set of stored causes comprises a cause selected from the group consisting of a implement not placed at the correct angle fault, an incorrect rivet used fault, a rivet damaged fault, a too wide hole fault, a too narrow hole fault, a no rivet fault, a rivet not gripping both parts to be connected fault, a setting tool defect fault, and any combinations thereof.

5. The setting tool as in claim 2, wherein said measuring device comprises a strain gage or a piezoelectric sensor.

6. The setting tool as in claim 2, wherein said measuring device is capacitive sensor and said measured value is a position of said pulling apparatus.

7. The setting tool as in claim 2, wherein said measuring device comprises at least three sensors arranged on said head piece and said measured value is an angle of the setting tool to the surface.

8. The setting tool as in claim 2, further comprising a data storage device.

9. The setting tool as in claim 8, wherein said data storage device is resettable.

10. The setting tool as in claim 8, further comprising an independent power source for said data storage device.

11. The setting tool as in claim 2, further comprising an independent power source for said processor.

12. The setting tool as in claim 2, further comprising a counter, said counter counting a variable selected from the group consisting of a number of rivet setting cycles, a number of faults, a number of fault causes, and any combinations thereof.

13. The setting tool as in claim 2, further comprising a registering device, said registering device registering a variable selected from the group consisting of a date, a time of day, and any combinations thereof.

14. The setting tool as in claim 2, further comprising an external unit and a transmitting device for transmitting said measured value from said processor to said external unit.

15. The setting tool as in claim 14, wherein said transmitting device comprises a device selected from the group consisting of an infrared transmitter, an ultrasound transmitter, a radio signal transmitter, and an optical conductor.

16. The setting tool as in claim 14, wherein said external unit comprises a computing unit.

17. The setting tool as in claim 14, wherein said external unit comprises a mobile radio terminal.

18. The setting tool as in claim 2, wherein said processor is adapted to switch off the setting tool in response to said cause.

19. The setting tool as in claim 2, wherein said processor is connectable to a local network.

20. The setting tool as in claim 2, wherein said pulling apparatus comprises a draw spindle and said gripping device comprises a set of clamping jaws for clamping the rivet.

21. The setting tool as in claim 2, wherein said pulling apparatus is operated by a driving device selected from the group consisting of an electrical drive, a hydraulic drive, a pneumatic drive, and any combinations thereof.

22. The setting tool as in claim 2, further comprising a test cycle for testing the setting tool.

23. A method for monitoring a rivet setting operation, comprising:

inserting a rivet into a setting implement having a pulling apparatus;

applying a tensile force to said rivet via said pulling apparatus;

measuring a variable associated with the rivet setting operation;

comparing said measured value to a stored value; and determining a cause for a deviations of said measured value from said stored value from a set of stored causes.

24. The method as in claim 23, wherein said measured value comprises a value selected from the group consisting of said tensile force, a position of said pulling apparatus, an elapsed time of the setting operation, an angle of said setting implement with respect to a surface on which said setting implement is placed, and any combinations thereof.

25. The method as in claim 23, wherein said set of stored causes comprises a cause selected from the group consisting of a implement not placed at the correct angle fault, an incorrect rivet used fault, a rivet damaged fault, a too wide hole fault, a too narrow hole fault, a no rivet fault, a rivet not gripping both parts to be connected fault, a setting tool defect fault, and any combinations thereof.

26. The method as in claim 23, further comprising counting a variable selected from the group consisting of a number of rivet setting cycles, a number of said deviations, a number of said causes, and any combinations thereof.

27. The method as in claim 23, further comprising registering a variable selected from the group consisting of a date, a time of day, and any combinations thereof.

28. The method as in claim 23, further comprising communicating a signal to an external unit, said signal being selected from the group consisting of said measured value, said cause, said deviation, and any combination thereof.

29. The method as in claim 23, further comprising indicating said cause to an operator.

30. The method as in claim 23, further comprising turning off said setting implement in response to said deviation.

31. A head piece for a setting tool, comprising:

a measuring device for measuring a value occurring during a setting operation;

a comparing device for comparing said values to a stored value;

a determining device for determining a cause of a deviation of said value from said stored value from a set of stored causes.

32. The head piece as in claim 31, wherein said measured value comprises a value selected from the group consisting of an elapsed time, an angle of the head piece to a surface, and any combinations thereof.

33. The head piece as in claim 31, wherein said measuring device is a strain gage or a piezoelectric sensor for measuring tension.

34. The head piece as in claim 31, wherein said measuring device is a capacitive sensor for measuring a pulling apparatus position.

35. The head piece in claim 31, wherein said measuring device is at least three sensors for measuring an angle of the head piece.

36. The head piece as in claim 31, further comprising a data storage device.

37. The head piece as in claim 36, wherein said data storage device is resetable.

38. The head piece as in claim 31, further comprising an independent power source for powering said comparing device and/or said determining device.

39. The head piece as in claim 31, further comprising a counter for counting a variable selected from the group consisting of a number of rivet setting cycles, a number of said deviations, a number of said causes, and any combinations thereof.

40. The head piece as in claim 31, further comprising a registering device for registering a variable selected from the group consisting of a date, a time of day, and any combinations thereof.

41. The head piece as in claim 31, further comprising a transmitting device for transmitting said measured value to an external unit.

42. The head piece as in claim 31, further comprising a switching device for switching off the head piece in response to said deviation.

43. The head piece as in claim 31, further comprising a connection device for connecting to a local network.

44. A rivet setting tool comprising:

a head piece for holding a rivet having a rivet pin;

a gripping device for gripping said rivet pin;

a pulling apparatus connected to said gripping device;

at least one piezoelectric sensor for measuring a tension exerted by said pulling apparatus on said rivet pin; and a communication device for communicating said tension to an external unit.

45. The rivet setting tool as in claim 44, further comprising a measuring device for measuring a position of said pulling apparatus.

46. The rivet setting tool as in claim 44, further comprising a pressure sensor for measuring said tension.

47. The rivet setting tool as in claim 44, wherein said pulling apparatus comprises a drive selected from the group consisting of an electric drive, a hydraulic drive, a pneumatic drive, and any combinations thereof.

48. The rivet setting tool as in claim 44, wherein said communicating device communicated said tension to said external unit via a signal selected from the group consisting of an infrared signal, an ultrasound signal, a radio signals, an optical signal, and any combinations thereof.

49. The rivet setting tool as in claim 44, further comprising a switching device for switching off the rivet setting tool in response to said tension.

50. A method for monitoring a rivet during a setting operation, comprising:

applying a tension the rivet;

measuring a change in length of the rivet; and comparing said change in length to a desired value.

51. The method as in claim 50, further comprising separating out the rivet if said change is outside a predefined tolerance band from said desired value.

52. The method as in claim 50, further comprising marking the rivet if said change is within a predefined tolerance band from said desired value.

* * * * *